US005478049A

United States Patent [19]

Lescoe

[11] Patent Number: 5,478,049

[45] Date of Patent: Dec. 26, 1995

[54] QUICK DRAIN VALVE

[76] Inventor: Robert J. Lescoe, 33029 Hampshire, Westland, Mich. 48185

[21] Appl. No.: 406,709

[22] Filed: Mar. 20, 1995

[51] Int. Cl.[6] ..... F16K 1/00

[52] U.S. Cl. ..... 251/322; 251/100; 251/354

[58] Field of Search ..... 251/100, 321, 251/354, 322

[56] References Cited

U.S. PATENT DOCUMENTS 2,692,112 10/1954 Szitar, Jr. ..... 251/354 X
2,855,946 10/1958 Machall ..... 251/354 X

FOREIGN PATENT DOCUMENTS 302006 10/1932 Italy ..... 251/100

*Primary Examiner*—John C. Fox
*Attorney, Agent, or Firm*—Donald P. Gillette

[57] ABSTRACT

A drain valve has a hollow body threaded to be screwed into a sump drain hole. A stem longer than the body is slidable and rotatable therein, and a washer encircles the stem adjacent the end facing into the sump. A longitudinal channel extends along the stem from its second end to an opening adjacent the washer, and a flange attaches the stem to a wall that covers a groove that extends longitudinally along the outer surface of the valve body, except for a portion offset laterally at the end of the groove closest to the threaded end of the body. A ball is captured between the groove and a recess in the surface of the wall facing the groove. The valve is normally held closed by a spring that forces the stem to slide longitudinally away from the interior of the sump to draw the washer against the body, thereby sealing the stem to the body. To open the valve, the stem is forced longitudinally along the body in opposition to the spring pressure to bring the channel opening within the sump. The stem can then be rotated to move the ball into the laterally offset portion of the groove, in which position spring pressure forces the ball against the side of the lateral portion of the groove and prevents the stem from moving axially while liquid flows out of the sump through the channel.

17 Claims, 2 Drawing Sheets

QUICK DRAIN VALVE

BACKGROUND OF THE INVENTION

1. Field of the Invention

This invention relates to the field of valves for draining tanks and sumps quickly and easily. In particular, it relates to quick-drain valves that can be locked in the open position for unattended draining.

2. The Prior Art

One type of drain valve is used to check the fuel in the tanks of an aircraft to be sure that it is not contaminated by water. Such valves have springs that keep them normally closed fluid-tight to prevent any leakage at all except when the valve is deliberately opened to allow a small quantity of the fluid to flow out, usually into a transparent container. It is customary to hold the small container to the light to see if any water has condensed in the tank and settled to the bottom. If it has, the valve may be held open a short additional time to allow all of the condensed water to drain out, but it is important that, once the person making the check has finished doing so, the spring loading in the valve return the valve to its shutoff condition without fail. Since a detent that would hold the valve in the open position until the valve was deliberately shut off could make it easy for the valve to be accidentally left open, thereby draining the tank of all fuel, detents are specifically not included in such valves. One example of such a valve is shown in U.S. Pat. No. 3,198,016 to Poorman and another is shown in U.S. Pat. No. 2,506,722 to Kuehn et al.

A similar valve is shown in U.S. Pat. No. 2,577,654 to Gates and is used to vent air from hot water radiators. As in the case of aircraft fuel-checking valves, it important that the venting valve of Gates return to its closed condition as soon as pressure is released, and, thus, no detent is provided.

U.S. Pat. No. 2,690,895 to Barcus provides a spring retention device, but Barcus does not suggest a groove extending longitudinally along the body of his valve and having a laterally offset portion at the end of the groove to provide a positive lock to hold the valve in the open position. Instead, he uses an annular groove engaged by spring fingers which are attached to the valve stem and merely press inwardly along a sloping surface to hold his valve open. The spring that urges the stem of his valve to the closed position continuously exerts longitudinal pressure that tends to overcome the holding force of the spring fingers and return the valve to the closed position, which makes the valve too prone to premature closure.

Szitar, Jr. depends on having four balls move in a radial direction in response to the combined pressure of opposing forces developed between sloping surfaces and a radial surface to lock and unlock his valve stem so that it can move longitudinally to open and close his valve in U.S. Pat. No. 2,692.112. In addition, the end of his stem extends radially out too far to fit into the passage through the body of the valve to allow the stem to be replaced because of wear.

Laipply et al. show a drain valve in U.S. Pat. No. 4,745,894 that requires an additional sleeve outside the body of the valve to cooperate with a ball that moves radially to release the lock and allow the stem to move to a position in which the valve is open.

OBJECTS AND SUMMARY OF THE INVENTION

It is an object of this invention to provide a simple drain valve that can be installed and then can be operated quickly and easily to drain fluid out of a tank or other receptacle and can be locked in the open position against a bias that urges it toward a position in which it is firmly and fully closed.

Another object is to provide a quick-drain valve that has a minimum number of easily produced parts that are easy to assemble to form a valve that is easy to use.

Yet another object is to provide a drain valve in which the person manipulating the component that opens and closes the valve is protected from any contact with a stream of the fluid that passes through the valve.

Those who are skilled in the technology with which this invention deals will recognize further objects after studying the following description.

A valve according to this invention includes a hollow body with two inner diameters, the smaller near a first end and the larger near the other end, thus defining an interior shoulder at the junction of the inner diameters. The end that has the smaller internal diameter is the one to be inserted into a tank or sump or other receptacle to be drained and will be referred to in this description and the following claims as the inner end. The outer surface of the body includes means, such as a threaded portion, to hold the valve firmly in place in an aperture in the receptacle with the inner end of the valve facing the interior of the receptacle.

A stem having an external diameter slightly less than the smaller inner diameter of the body slides freely in the longitudinal direction in the body. The stem is longer than the body, and one end of the stem, referred to as the inner end, extends past the inner end of the body while the other, or outer, end of the stem extends past the outer end of the body. The stem has a passage, such as an axial bore, that has an entrance near the inner end of the stem and extends to the outer end of the stem. Between the entrance to the passage and the inner end of the stem is an annular washer, such as an O-ring, that forms a fluid-tight seal between the stem and the inner end of the body when the stem is drawn firmly in the direction toward the outside of the receptacle. The force to draw the stem in that direction is provided by a spring in the annular space between the stem and the larger inner surface of the body. One end of the spring bears against the interior shoulder and the other end against a stop rigidly attached to the outer end portion of the stem and extending outwardly therefrom. The perimeter of the stop is joined to a tubular part that is coaxial with the stem and extends in the direction toward the inner end of the stem. The stop and its tubular part comprise a knob that is convenient to grasp to move the stem relative to the body of the valve. The body of the valve has an external longitudinal groove, and a ball, which fits in a recess in a tubular part, is captured between the tubular part and the groove. This constrains the knob and the stem attached to it to move only as permitted by the groove.

In order to lock the valve in the open condition, the end of the groove closer to the inner end of the valve has a laterally offset section. When the knob is forced, against the pressure of the spring, to move longitudinally toward the inner end of the body ball until the ball reaches the end of its longitudinal range of travel along the groove, the knob can then be turned to allow the ball to move into the laterally offset section. Pressure of the spring compressed between the interior shoulder and the stop then simply forces the ball against the side of the lateral section of the groove and is no longer effective to move the knob and, thereby, the stem toward the outer end of the body in the direction to close the valve.

The invention will be described in greater detail in connection with the drawings, in which like serial numbers in different figures indicate the same item.

DETAILED DESCRIPTION OF A PREFERRED EMBODIMENT

Figure 1:
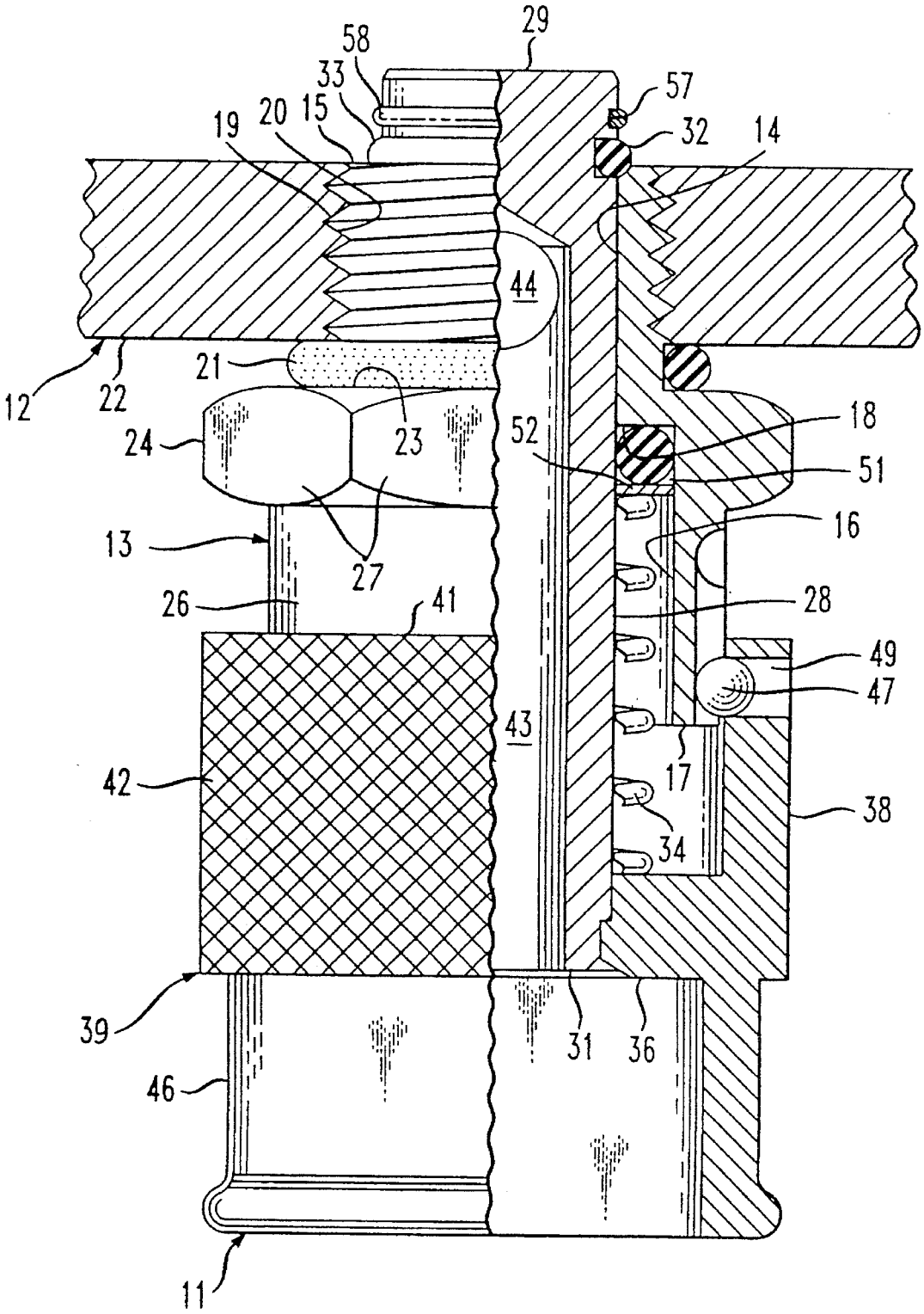
FIG. 1 is a side view, partially cross-sectioned, of one embodiment of a valve according to this invention, shown in its closed condition.
Figure 2:
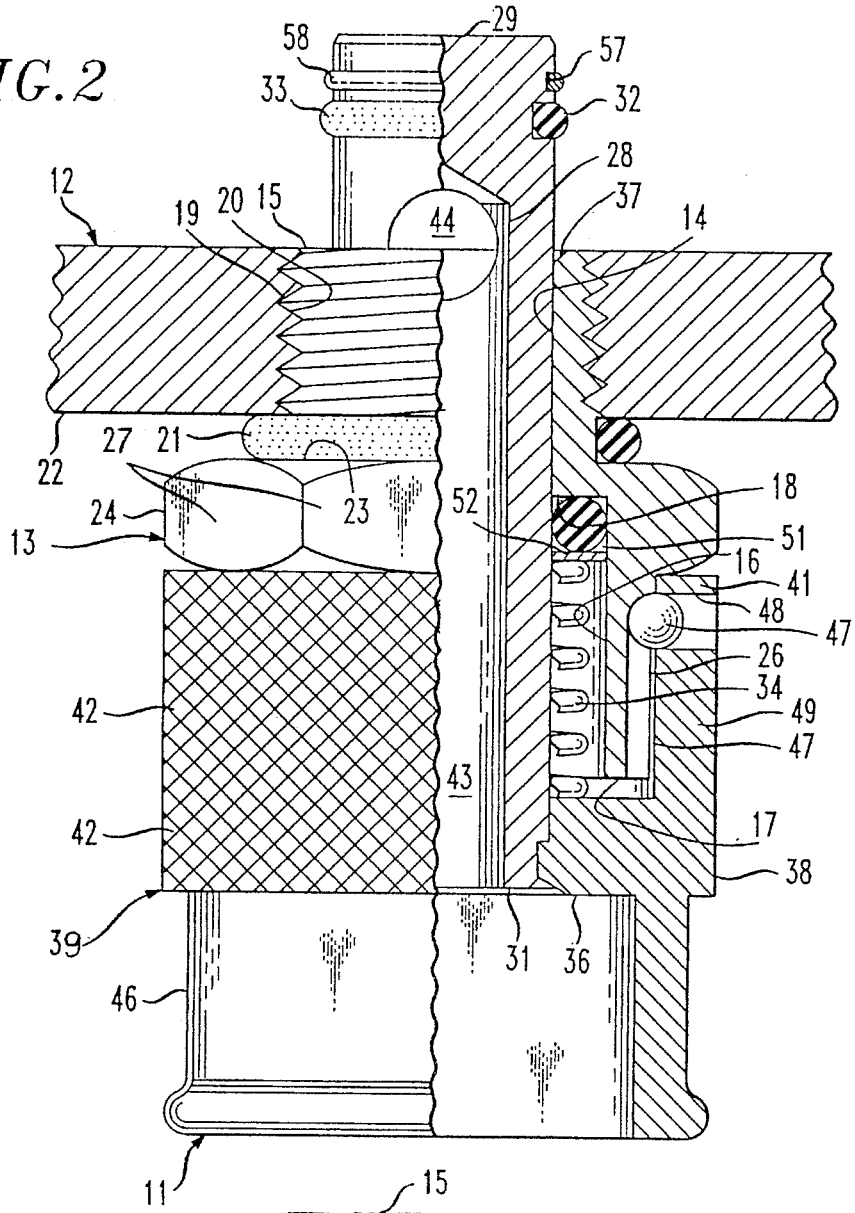
FIG. 2 is a side view, partially cross-sectioned, of the valve in FIG. 1 in its open position.

FIGS. 1 and 2 show a valve 11 suitable for use in draining a tank or sump or other form of receptacle 12, only a small fragment of which is shown. The valve comprises a hollow, generally cylindrical body 13 that has an axial bore, one portion 14 of which adjacent one end 15 has a smaller inner diameter than a second portion 16 adjacent the opposite end 17. The portions 14 and 16 of the inner wall define an interior shoulder 18 where they meet. The end 15 of the body will be referred to in the following description as the inner end since it is the end that extends into, or at least faces, the interior of the receptacle to be drained, and the opposite end 17 of the body will be referred to as the outer end.

In order to join the valve fluid-tight to the receptacle 12, the body 13 has an external thread 19 at or near the inner end 15 to match an internally threaded drain hole 20 in the bottom of the receptacle 12. The drain hole in some receptacles is threaded according to a standard tapered pipe thread. By forming the thread 19 with a corresponding taper, no washer is required to from a fluid-tight joint between the receptacle and the valve. In other receptacles in which the hole 20 is not tapered, a valve with a corresponding non-tapered thread 19 is used. Instead, it is necessary, or at least preferable, to use a washer 21, shown as an O-ring, clamped between the outer surface 22 of the receptacle 12 and a juxtaposed surface 23 of a flange 24.

The flange 24, which is located between the thread 19 and a tubular portion 26 that extends from the flange 24 to the end 17, also serves as means by which the valve can be gripped by a wrench or another tool to transmit sufficient torque to the body 13 to tighten it firmly in place on the receptacle 12. For this purpose, the perimeter of the flange has a plurality of flat surfaces 27. In this instance, there are six such surfaces, giving the flange 24 a hexagonal form.

Within the body 13 is a cylindrical stem 28, the outer diameter of which is just enough smaller than the diameter of the smaller portion 14 of the bore through the body to allow the stem to slide freely longitudinally between a position in which the valve is closed and a position in which it is open. The stem 28 is longer than the body 13, so that one end 29 extends beyond the inner end 15 of the body while the other end 31 extends beyond the outer end 17. To use corresponding terminology, the end 29 will be referred to as the inner end of the stem and the end 31 as the outer end.

Spaced a short distance from the inner end 29 is an annular groove 32 that holds an elastomeric washer 33, such as an O-ring, the purpose of which is to form a fluid-tight seal between the body 13 and the stem 28 when the valve 11 is closed, as it is in FIG. 1. In that condition, the O-ring 33 is forced against the end 15 of the body by a helical compression spring 34 located in the annular space between the stem and larger bore 16 and axially constrained between the shoulder 18 and a flange 36 that extends outwardly from the stem at the end 31. A small chamfer 37 is provided at the end 15 to cooperate with the O-ring 21 in sealing the body fluid-tight to the stem. The flange 36 may be formed as an integral part of the stem 28 or it may be formed as a separate component and then attached to the outer end 31, for example by being forced onto it and then having the end 31 spun into gripping engagement with the flange.

At the perimeter of the flange is a cylindrical wall 38 that may either be formed integrally with the flange or joined rigidly and securely to it. In either case, the flange 36 and the cylindrical wall define a cup 39, which extends back over part of the body 13 and forms, in effect, a knob to be used in switching the valve 11 from its closed position to its open position. The cup has a rim 41 and a rough outer surface 42 that provides a good gripping surface for manipulation of the cup and, thereby, the stem 28.

The stem 28 has an inner passage 43 with an entrance 44 through which fluid can drain out of the receptacle 12 when the valve is opened, which is accomplished by pushing the cup 39 toward the receptacle to the position shown in FIG. 2. The passage 43 is formed by drilling a blind axial hole from the outer end 31 to a location between the end 31 and the O-ring 33, thereby giving this part of the stem an annular cross section, and the entrance 44 is formed by drilling a transverse hole in the stem to intersect the passage 43 near its closed end.

Movement of the stem 28 relative to the body by sufficient axial pressure exerted on the cup 39 to overcome the resilient force of the spring 34 shifts the entrance 44 to the position shown in FIG. 2 in which it is at least partially clear of the end 15. The entrance is then open to the interior of the receptacle 12, which allows fluid in the receptacle 12 to flow into the entrance and to flow on out through the passage 43. In this embodiment, there is a tubular extension 46 from the lower surface of the cup 39 to facilitate attaching a hose to take away the fluid being drained from the receptacle, but this extension is not a required part of the valve 11.

The longitudinal movement of the cup 39 is guided by a ball 47 that moves in a longitudinal groove 48 that extends from the outer end 17 of the body 13 toward the flange 24. The wall thickness of the tubular portion 26 of the body is great enough so that the groove 48 need only be milled part of the way through without entering the annular chamber in which the spring 34 is located, thereby helping to separate the ball from any seepage of fluid down along the slight annular space between the outer surface of the stem 28 and the inner wall surface 14. The ball is held in a recess 49 in the cup 39 formed by drilling a hole slightly smaller than the diameter of the ball 47. The ball can be placed in this recess as the valve is assembled and cannot thereafter escape.

When the stem 28 is in the position shown in FIG. 2, the 0ring 33 no longer prevents leakage of fluid from the receptacle down along the narrow, annular passageway between the external surface of the stem and the inner wall 14, which could eventually gum up the space in which the spring 34 is located. To prevent such leakage, another elastomeric washer 51, which is illustrated as an O-ring, is located within the larger diameter portion of the passage 43 against the shoulder 18, substantially filling the annular space between the stem 28 and the portion 16 of the inner wall adjacent the shoulder 18. A flat metal washer 52 that has dimensions almost filling the annular space is located between the O-ring 51 and the proximal end of the spring 34. The longitudinal pressure of the spring transmitted through the washer 52 to the 0ring 51 causes the latter to flatten enough to seal any gap between the stem 28 and the end of the wall surface 14 at the shoulder 18.

Figure 3:
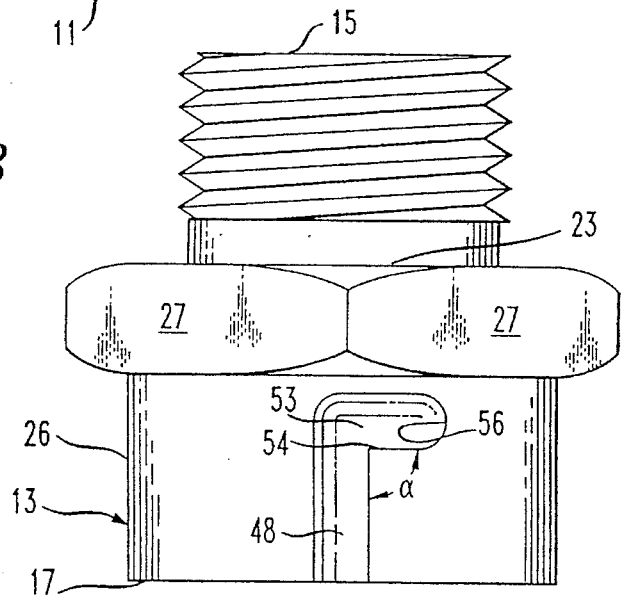
FIG. 3 is a side view of the body of the valve of FIG. 1 showing the slot that guides movement of the stem relative to the body.

FIG. 3 shows the body 13, alone, and in a position rotated 90° relative to its position in FIGS. 1 and 2. This shows the longitudinal groove 48 and, at the end of the groove closer to the inner end 15, a laterally offset portion 53 into which the ball 47 can be moved by rotating the cup 39 a few degrees in the proper direction, clockwise in this embodiment, to force the ball to move along the laterally offset portion. The length of the longitudinal groove 48 from the outer end 17 of the body 13 to the laterally offset portion 53 must be greater than the longitudinal distance from the O-ring 33 to the proximal edge of the entrance 44 and at least as great as the longitudinal movement of the stem 28 from the closed position of the valve 11, as illustrated in FIG. 1, to the open position illustrated in FIG. 2. The depth of the interior of the cup 39 is preferably approximately equal to the length of the entire tubular portion 26 of the body 13, and the longitudinal distance from the axis of the recess 49 to the rim 39 is preferably less than twice as great as the diameter of the ball 47 to allow the overall length of the valve to be as small as possible.

Once the ball is in the laterally offset portion 53, the force of the spring 34 simply pushes the ball against the side wall 54 of that portion. The angle $\alpha$ between the longitudinal portion of the groove 48 and the laterally offset portion can be as great as 90°, thereby making the laterally offset portion 53 perpendicular to the longitudinal direction of the body 13. Then, the pressure of the spring in the longitudinal direction cannot force the ball out of the laterally offset portion 53 and back into the groove 48, although vibration plus the spring pressure might do so, especially if the cup has been rotated only enough to get the ball 47 just barely into the offset portion. Preferably, the included angle $\alpha$ between the longitudinal direction and the laterally offset portion is less than 90° so that the end 56 of the portion 53 is slightly closer to the outer end 17 of the body 13 than is a location along the offset portion between the longitudinal groove 48 and the end 56. In that case, longitudinal force of the spring 34 tends to force the ball farther along the laterally offset to the end 56, thereby helping to hold the valve 11 in its open position so that it may be left unattended while the receptacle 12 drains.

The laterally offset portion 53 is also useful in assembling and disassembling the valve to service it, which may be necessary if the passage 43 or its entrance 44 gets clogged up. Between the groove 32 and the inner end 29 is another annular groove 57 that holds a C-shaped spring clip 58. The O-ring 33 and the spring clip are the only parts that extend radially out beyond the cylindrical surface of the stem 28 at its inner end 29. Without these parts, the end 29 of the stem would be forced back into the body 13 by pressure of the spring on the flange 36. The spring clip 58 serves as a back-up to the O-ring 33 and helps hold it in its groove 32.

In assembling the components, once the spring 34 has been placed on the stem 28 and the stem has been inserted into the body 13, the cup 39 has to be forced far enough against the spring pressure to allow the inner end 29 of the stem 28 to extend beyond the inner end 15 of the body a sufficient distance so that the O-ring 33 and the spring clip 58 can be forced over the end 29 and into their respective grooves 32 and 57. By twisting the cup 39 when the ball 47 reaches the end of its range of travel along the groove and forcing the ball 47 to enter the laterally offset portion 53, the end 29 can be held extended by the detent action, and the washer and spring clip can be put in place without any necessity for the person doing the assembly to maintain finger pressure on the cup 39. Similarly, if the stem has to be removed, perhaps to replace it, the cup 39 can be force longitudinally against the pressure of the spring and then twisted into the holding position to be retained there while the spring clip 58 and the O-ring 33 are removed.

The invention has been described in terms of a specific embodiment, but it will be apparent to those skilled in the technology with which this invention deals that the concept may be embodied in other forms without departing from the true scope of the invention.

What is claimed is:

1. A quick-drain valve comprising:

(a) an elongated body having:

(i) first and second ends a predetermined distance apart, (ii) a first portion adjacent the first end having an annular cross section with a first internal diameter, and (iii) a second portion adjacent the second end having a larger internal diameter and defining, with the first portion, an internal shoulder, the second portion having a predetermined external diameter and a predetermined wall thickness between the internal and external diameters, (iv) tightening means on the first portion to hold the body in fluid-tight engagement with a receptacle, and (v) a groove extending along the external surface of the second portion and a laterally offset portion at the end of the groove closer to the first end;

(b) a stem having:

(i) an external diameter fitting slidably into the first internal diameter in the first portion and having:

(ii) a first stem end extending out of the elongated body beyond the first end, (iii) a second stem end extending out of the body beyond the second end, (iv) an elongated passage extending along the stem from a first location to a second location, (v) an entrance to the passage at the first location;

(c) stop means rigidly joined to the stem to prevent the second stem end from passing through the body;

(d) annular fluid sealing means extending outwardly from the stem between the first stem end and the entrance to form a fluid-tight seal between the stem and the body;

(e) resilient means surrounding the stem and within the second portion of the elongated body to exert longitudinal force against the shoulder and the stop means to press the annular fluid sealing means into a closed position in which the fluid sealing means is in fluid-tight sealing engagement between the stem and the body;

(f) gripping means rigidly attached to the stem adjacent the second stem end to allow pressure to be exerted on the stem to stress the resilient means and to force the fluid sealing means to move away from fluid-tight sealing engagement between the stem and the body entrance to the passage to move beyond the first end of the body to a flow position to allow fluid to enter the entrance and pass through the passage; and (g) guide means engaging the groove to guide movement of the stop means and the stem along the body from the closed position to the flow position.

2. The quick-drain valve of claim 1 in which the rotational driving member is longitudinally spaced from the first end toward the second end.

3. The quick-drain valve of claim 2 in which the rotational driving member comprises flat surfaces to be engaged by a wrench.

4. The quick-drain valve of claim 1 in which the laterally offset portion at the end of the groove extends in a direction to lock the guide means to hold the stem in the flow position.

5. The quick-drain valve of claim 1 in which the guide means is a ball captured in the groove by the stop means.

6. The quick-drain valve of claim 1 in which the gripping means extends in overlapping relation with a part of the body between the second end and the rotational driving member.

7. The quick-drain valve of claim 1 in which the resilient means surrounding the stem is a removable ring.

8. The quick-drain valve of claim 7 in which the stem further comprises an annular groove between the one end and the entrance, and the ring is an O-ring seated in the annular groove.

9. The quick-drain valve of claim 7 in which the stem further comprises a second annular groove between the first-named annular groove and the one end, and the valve further comprises a resilient metal clip resiliently retained in the second annular groove.

10. The quick-drain valve of claim 1 in which the stem has a uniform diameter from the resilient means to the stop means.

11. The quick-drain valve of claim 1 in which the stop means is an integral part of the stem at the second stem end.

12. The quick-drain valve of claim 1 in which the stop means is in the form of a cup having a bottom attached to the second stem end and a tubular portion that extends toward the first stem end concentrically with the stem and radially outwardly spaced from the second portion of the body.

13. A quick-drain valve comprising:

(a) a round elongated body having:

(i) first and second ends a predetermined distance apart, (ii) a first portion adjacent the first end having an annular cross section with a first internal diameter, and (iii) a second portion adjacent the second end having a larger internal diameter and defining, with the first portion, an internal shoulder, the second portion having a predetermined external diameter and a predetermined wall thickness between the internal and external diameters, (iv) an external thread on the first portion to thread into a matching internally threaded receptacle, (v) a rotational driving member to grip the body to screw the external thread into the receptacle, and (vi) a groove extending along the external surface of the second portion and having a depth less than the wall thickness and a laterally offset portion at the end of the groove closer to the first end;

(b) a stem having an external diameter fitting slidably into the first internal diameter in the first portion and having:

(i) a first stem end extending out of the elongated body beyond the first end, (ii) a second stem end extending out of the body beyond the second end, (iii) an elongated passage extending along the stem from a first location to a second location, (iv) an entrance to the passage at the first location;

(c) stop means rigidly joined to the stem and extending outwardly therefrom adjacent the second stem end to prevent the second stem end from passing through the body;

(d) annular fluid sealing means extending outwardly from the stem between the first stem end and the entrance to form a fluid-tight seal between the stem and the body;

(e) resilient means surrounding the stem and within the second portion of the elongated body to exert longitudinal force against the shoulder and the stop means to press the annular fluid sealing means into a closed position in which the fluid sealing means is in fluid-tight sealing engagement between the stem and the body;

(f) protective gripping means rigidly attached to the stem adjacent the second stem end and extending alongside the second portion of the body to be gripped by hand between the first and second stem ends and out of the line of fluid flow through the passage to move the stem longitudinally relative to the body to allow pressure to be exerted on the stem to stress the resilient means and to force the fluid sealing means to move away from fluid-tight sealing engagement between the stem and the body entrance to the passage to move beyond the first end of the body to a flow position to allow fluid to enter the entrance and pass through the passage; and (g) guide means engaging the groove to guide movement of the stop means and the stem along the body from the closed position to the flow position.

14. The quick-drain valve of claim 13 in which the elongated passage is an axial bore extending along the stem from the second end to the entrance.

15. The quick-drain valve of claim 14 in which the entrance is a transverse bore that intersects the longitudinal bore.

16. The quick-drain valve of claim 14 in which the second location is at the second stem end.

17. The quick-drain valve of claim 16 in which the first location is displaced from the first stem end toward the second stem end.

* * * * *